US006101964A

United States Patent [19]

Lesesne

[11] Patent Number: 6,101,964

[45] Date of Patent: Aug. 15, 2000

[54] FLOATABLE AUXILIARY FUEL TANK

[75] Inventor: Edward R Lesesne, Panama, Panama

[73] Assignee: Edward R. Lesesne, Chapin, S.C.

[21] Appl. No.: 09/233,853

[22] Filed: Jan. 19, 1999

[51] Int. Cl.[7] ..... B65D 88/78

[52] U.S. Cl. ..... 114/256; 440/88

[58] Field of Search ..... 114/256, 257, 114/745, 242; 440/88

[56] References Cited

U.S. PATENT DOCUMENTS

| | | | |
|---|---|---|---|
| 4,007,700 | 2/1977 | Haynes et al. | 114/74 T |
| 4,790,350 | 12/1988 | Arnold | 244/135 R |
| 4,948,070 | 8/1990 | Lyman | 244/135 R |
| 5,139,278 | 8/1992 | Valsicak | 280/47.26 |
| 5,205,427 | 4/1993 | Crago et al. | 220/4.15 |
| 5,235,928 | 8/1993 | Shank, Jr. | 114/257 |
| 5,402,968 | 4/1995 | Baldwin et al. | 244/135 R |
| 5,613,459 | 3/1997 | Remy | 114/242 |
| 5,667,113 | 9/1997 | Clarke et al. | 222/608 |

*Primary Examiner*—Jesus D. Sotelo
*Attorney, Agent, or Firm*—Michael A. Mann; Nexsen Pruet Jacobs & Pollard

[57] ABSTRACT

A floatable fuel tank that is capable of serving as a barge or lifeboat/dingy. Tank comprises a plurality of bladders with each having a fuel chamber and air chamber running longitudinally from stern to a forward bladder. If used as a fuel storage device, tank is attached to boat using towing lines and fuel lines so boat consumes fuel held by fuel chambers. In emergency situations, tank is capable of use as a lifeboat by detaching towing lines, air lines and fuel lines and pumping fuel out of fuel chambers with air so that persons may reside on top of tank. Under normal conditions in this configuration, it could be used as a dingy for normal transportation to and from a boat at anchor.

17 Claims, 6 Drawing Sheets

FLOATABLE AUXILIARY FUEL TANK

BACKGROUND OF THE INVENTION

1. Field of the Invention

The present invention relates a floatable auxiliary fuel tank for a boat. In particular, the present invention relates to an auxiliary fuel tank that could also be used as a barge, dingy or converted to a life boat.

2. Discussion of Background

Yachts, pleasure boats, work boats, and other small water craft have limited fuel capacities. Typically, the fuel capacity for these types of vessels can vary from a few hundred to a thousand gallons of fuel. Unfortunately, the boat's large fuel capacity is offset by a high rate of fuel consumption. Most vessels consume more than a gallon of fuel per mile at a cruising speed of 20 knots. As a result, vessels making a long voyage need to plan them around fuel stops.

In order to extend fuel capacity, many boats carry several fuel containers capable of holding between 6–55 gallons. Examples of these containers are found in U.S. Pat. No. 5,139,278 to Vlasicak and U.S. Pat. No. 5,667,113 to Clarke et al. Unfortunately, these containers occupy precious deck space on the vessel. Moreover, many other items, such as dinghies and lifeboats, also compete for vessel deck space. The storage of these various items on the deck not only creates a logistical problem, but also a safety hazard. Therefore, there is a need for a solution to the problem of supplying auxiliary fuel capacity that does not further complicate the problem of limited deck storage area.

SUMMARY OF THE INVENTION

According to its major aspects and broadly stated, the present invention is a floatable fuel tank that is capable of serving as a barge, dingy or lifeboat. The term barge means a cargo-carrying vessel that is towed behind a boat, which in this case would be carrying fuel, while a lifeboat means a small watercraft that may serve as a boat in emergency situations or dingy for transportation in normal situations. The tank comprises a plurality of longitudinal bladders with each having a longitudinal fuel chamber and air chamber running longitudinally, all running from the stern to a forward bladder in the bow of the tank. To assure that the tank is self-leveling, preferably the outermost fuel chambers communicate with each other via a channel extending therebetween. If used as a fuel storage device, the tank is attached to the boat using towing lines and fuel lines so boat consumes fuel held by fuel chambers. In emergency situations, the tank is capable of being used as a lifeboat by detaching the towing lines and the fuel lines and pumping fuel out of the fuel chambers with air so that people may sit on top of the tank. The tank is collapsible if not inflated by either fuel or air and may be stored on the boat.

A major advantage of the present invention is the ability to extend the fuel capacity of a vessel without cluttering the deck. A consequence of this advantage is the boat can travel farther between fuel stops, perhaps shortening the overall distance it needs to travel. This results in overall better fuel economy. In addition, the auxiliary tank does not take up deck space when in use.

An important advantage of the present invention is its dual use as an auxiliary fuel tank and a life boat/dingy. The versatility of the present invention decreases cost for the consumer, while providing increased functionality.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 6:
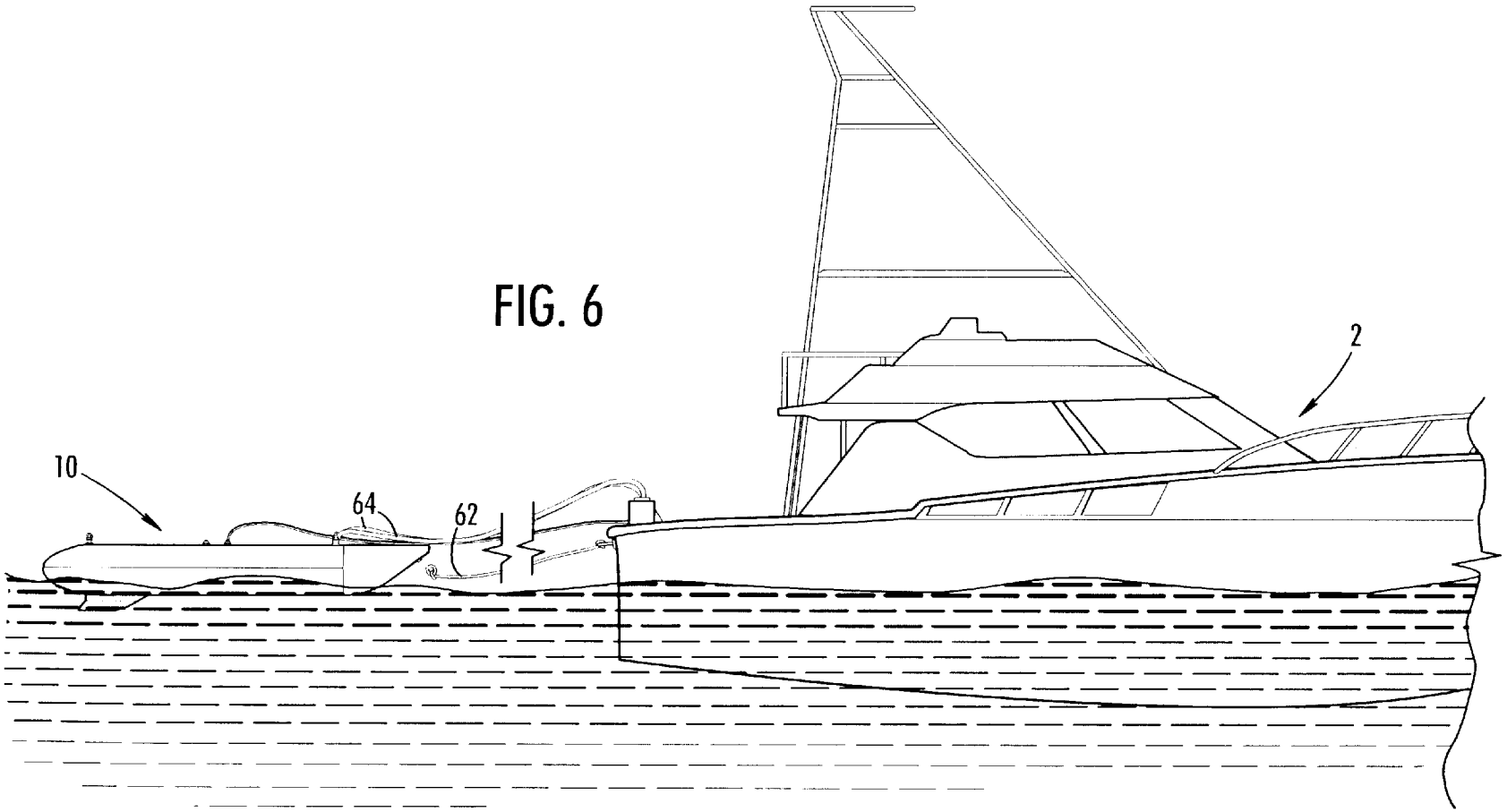
FIG. 6 is a side view of the tank connected to a boat, according to a referred embodiment of the present invention.
Figure 7:
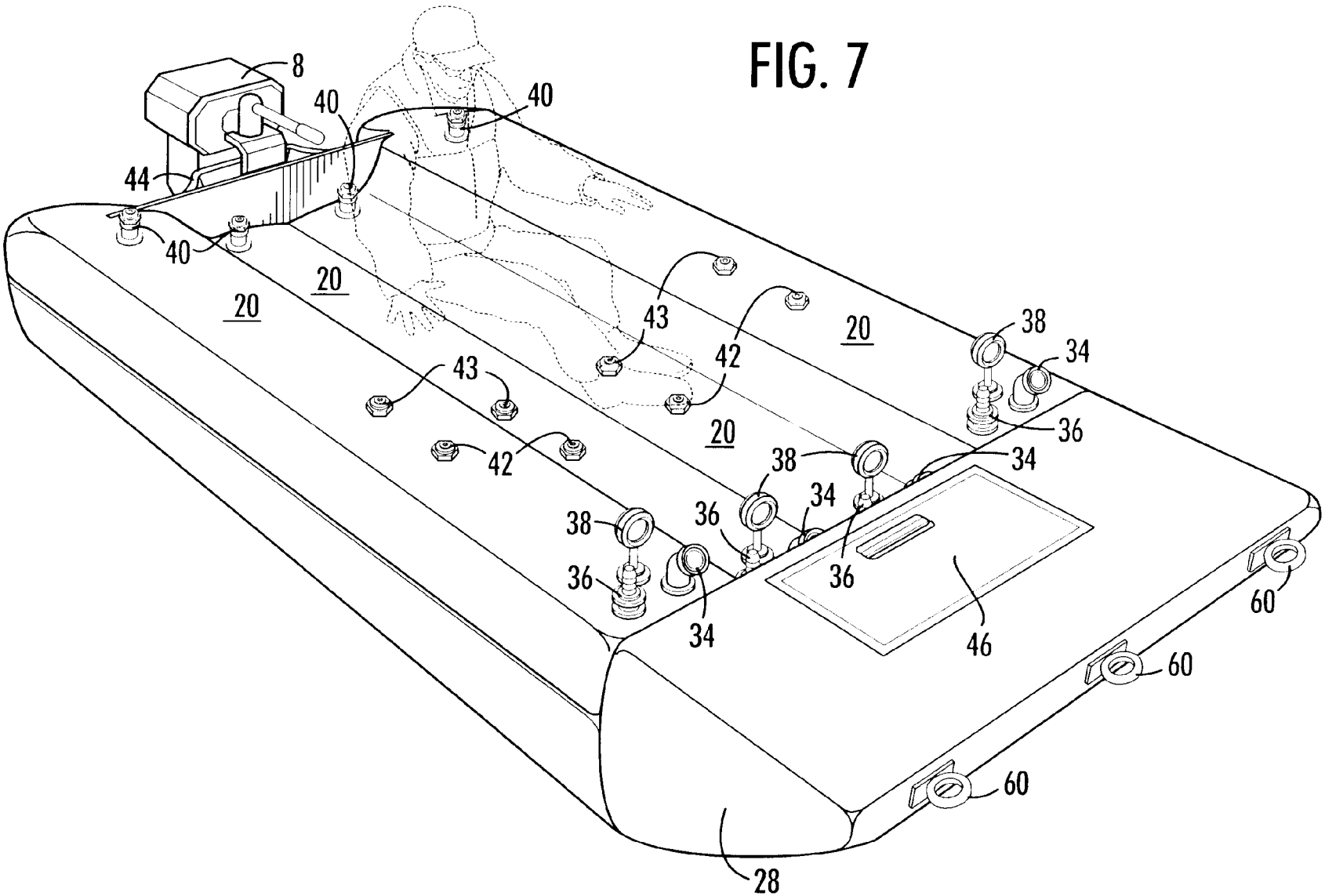
FIG. 7 is a perspective view of the tank configured as a life raft, according to a preferred embodiment of the present invention with a figure of a passenger shown in phantom lines.

Referring now to the figures, the present invention is a floatable fuel tank that is capable of serving as a barge or lifeboat/dingy. The term barge means a cargo-carrying vessel that is towed behind a boat, while a lifeboat/dingy is a small water-craft that may serve as a boat in emergency situations or transportation in normal situations. For purposes of orientation, the tank, generally referred to by reference number 10, has a bow 12, a stern 14, a top 16 and a bottom 18. Tank 10 comprises a plurality of bladders 20 with each having a fuel chamber 22 and air chamber 26 running longitudinally from stern to a forward bladder 28. If used as a fuel storage device, tank 10 is attached to boat 2 using towing lines 62 and fuel lines 64 so boat 2 consumes fuel held by fuel chambers 22 as illustrated in FIG. 6. In emergency situations, tank 10 is capable of use as a lifeboat by detaching towing lines 62, fuel lines 64, and air lines 66 and pumping fuel out of fuel chambers 22 with air so that passengers may sit on top 16 of tank 10 as illustrated in FIG. 7. If tank 10 is attached to a diesel engine, return fuel line must also be detached.

Tank 10 may have a plurality of bladders 20 extending from stern 14 to bow 12 with each capable of holding fuel. Although tank 10 may have any number of bladders 20 depending upon the desired fuel capacity, preferably four bladders 20 are used. Bladders 20 may also vary in their lengths and diameters depending upon the desired fuel capacity; however, bladders 20 preferably have a uniform length and diameter. Each bladder 20 is preferably formed from a synthetic rubber material, such as neoprene, or a like material.

Figure 1:
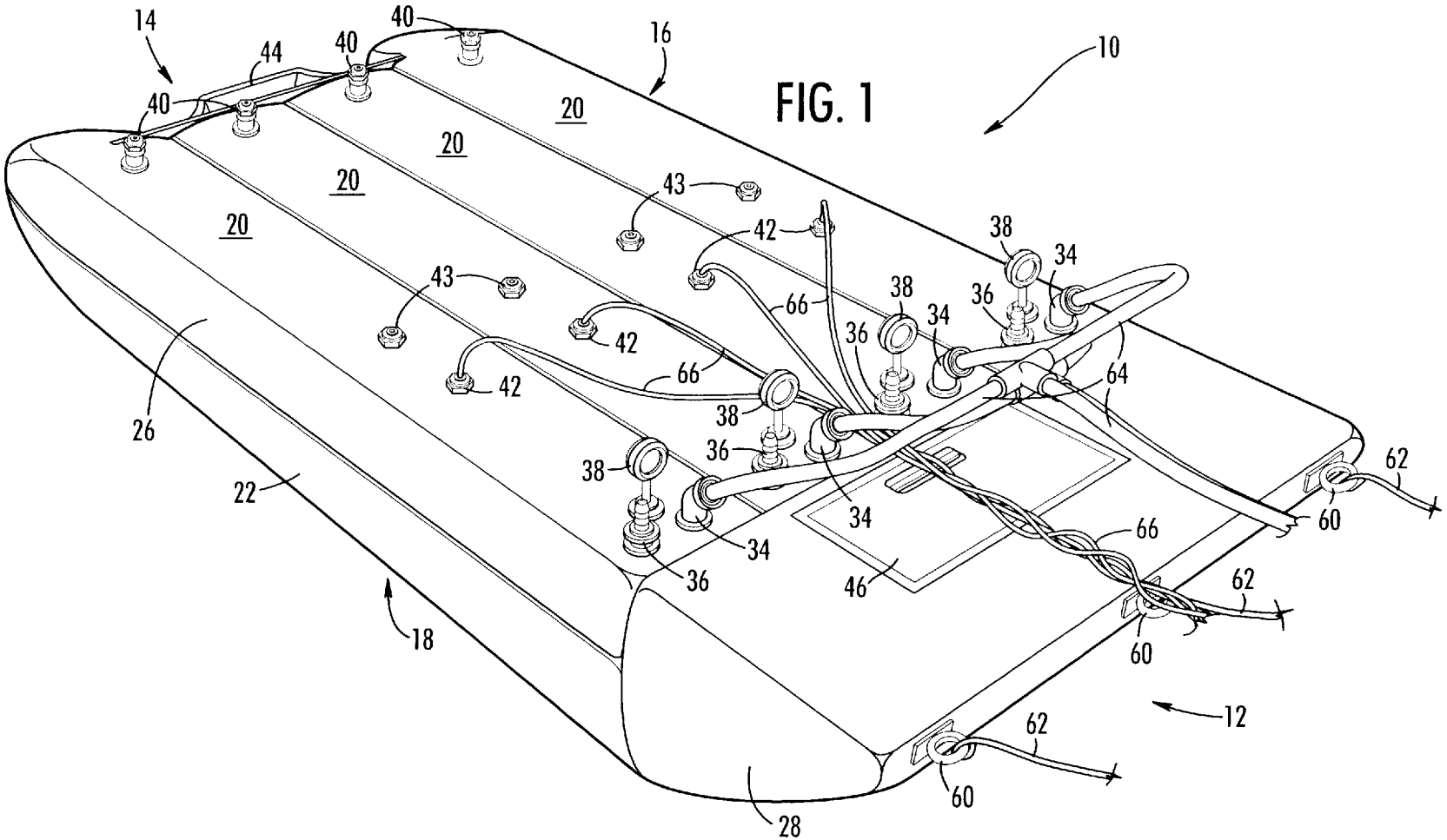
FIG. 1 is a perspective view of the tank, according to a preferred embodiment of the present invention.
Figure 2:
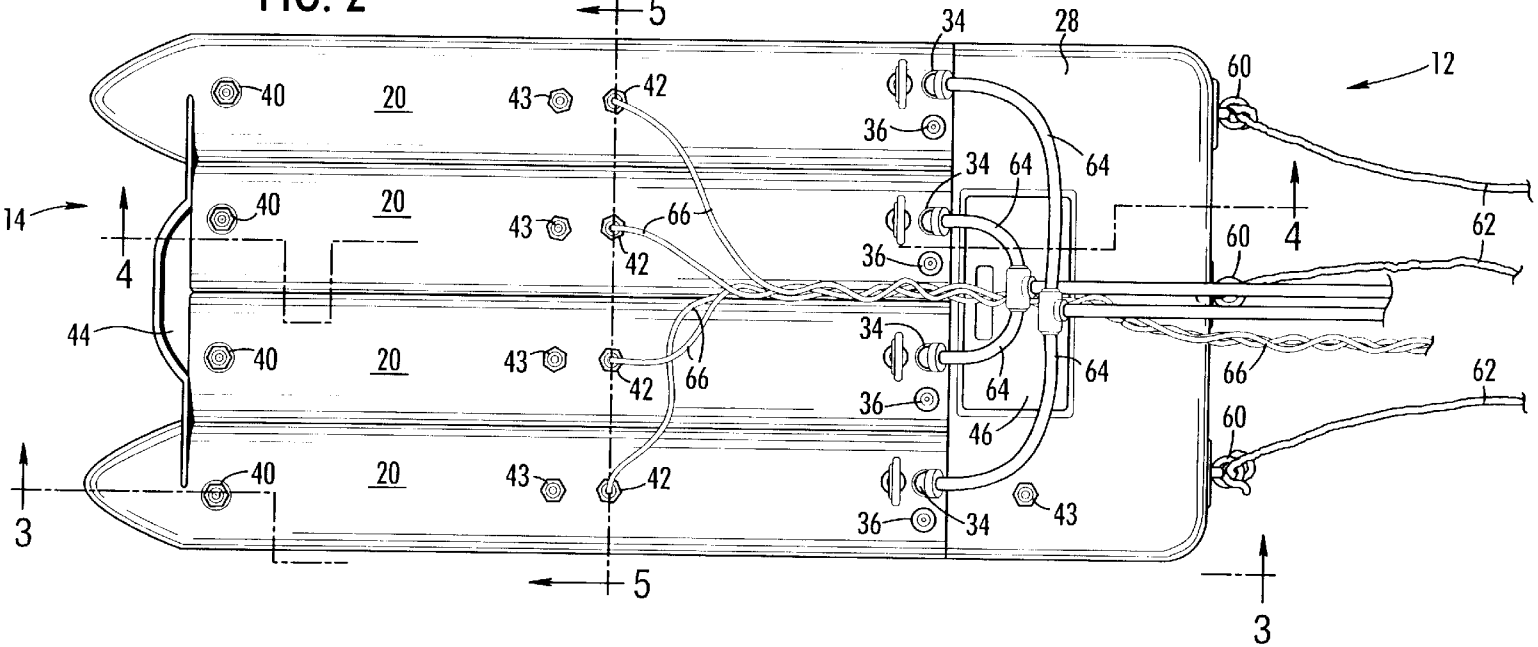
FIG. 2 is a top view of the tank, according to a preferred embodiment of the present invention.
Figure 3:
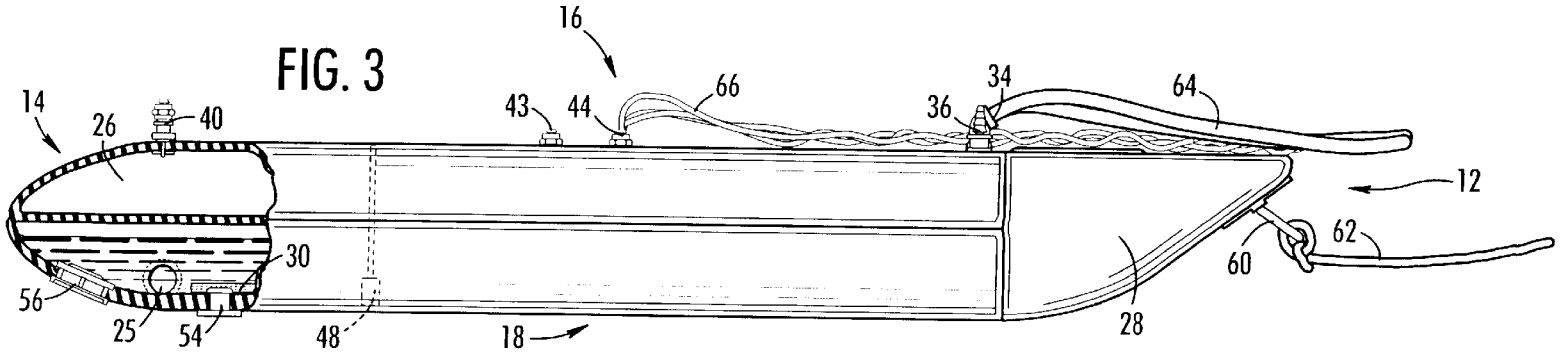
FIG. 3 is a side, partial cross-sectional view of the tank along line 3—3 of FIG. 2, according to a preferred embodiment of the present invention.
Figure 4:
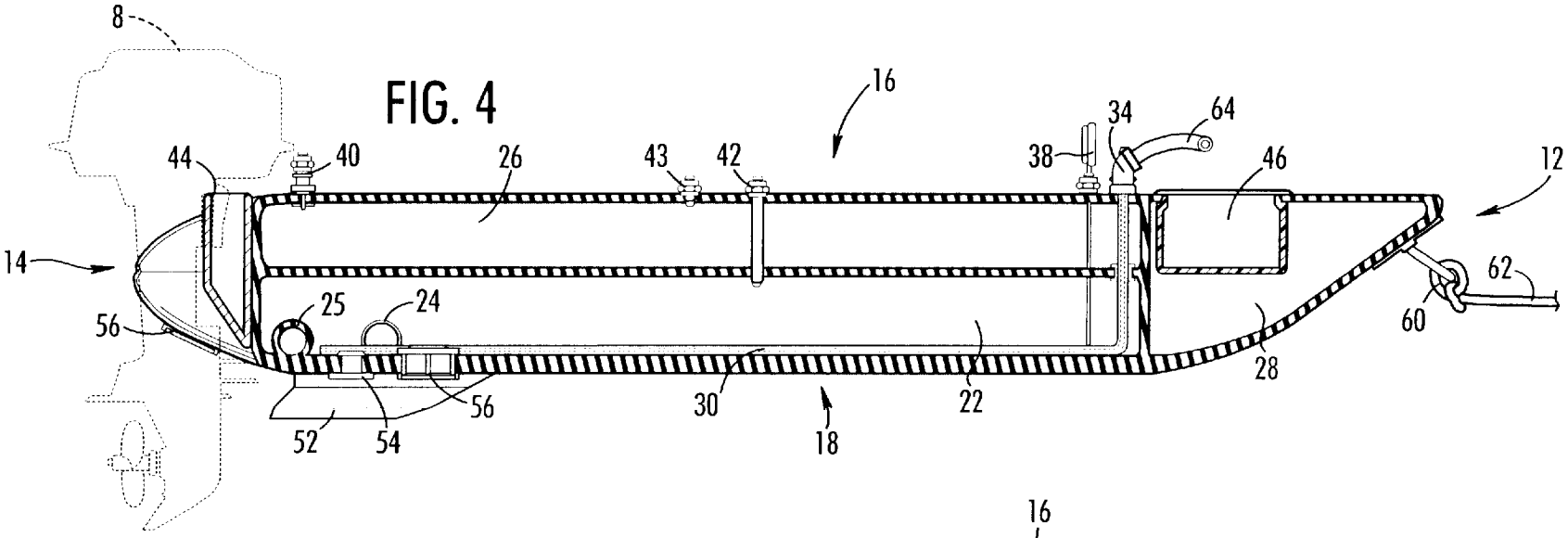
FIG. 4 is a side cross section view of the tank along line 4—4 of FIG. 2, according to a preferred embodiment of the present invention, with an outboard motor shown in phantom lines.
Figure 5:
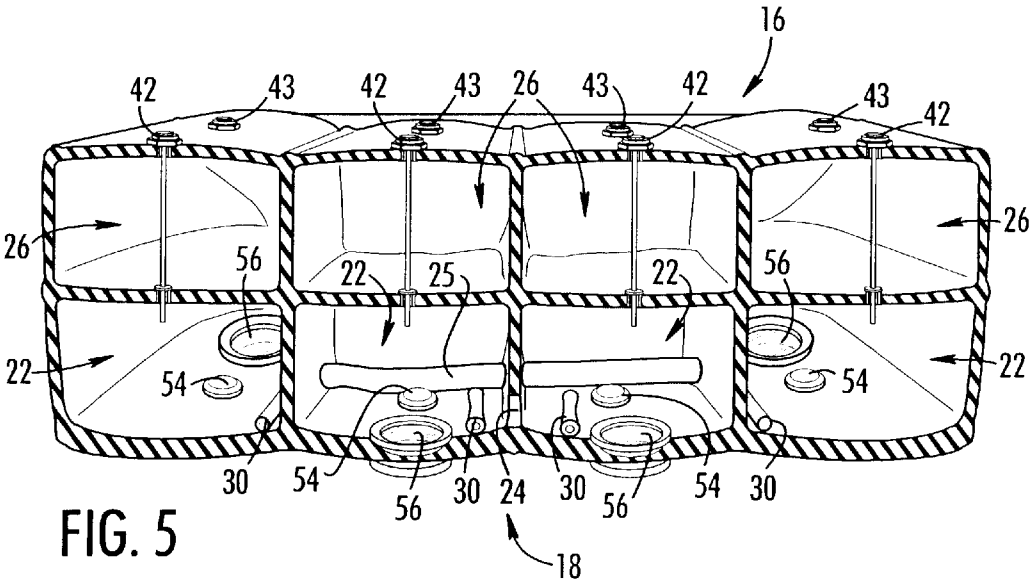
FIG. 5 is a front cross section view of the tank along line 5—5 of FIG. 2, according to a preferred embodiment of the present invention.

As illustrated in FIG. 4, each bladder 20 is preferably divided with a fuel chamber 22 and an air chamber 26 extending longitudinally from stern 14 to forward chamber 28. Fuel chambers 22 hold fuel while air chambers 26 are filled with air. Preferably, fuel chambers 22 are positioned at the bottom 18 of bladder 20 while air chambers 26 are positioned at the top 16.

Fuel chambers 22 are preferably in fluid communication with the engine on boat 2 so that boat 2 can consume fuel on tank 10, but could be in fluid communication with an internal fuel tank on boat 2 so that the internal fuel tank is replenished as the engine consumes fuel from internal fuel tank. Also, fuel could be transferred from fuel chambers to the boat's internal fuel tank while the engine is not in use. A valve (not shown) positioned on boat 2 could be attached to fuel lines 64 so that the user could choose between consuming fuel in tank 10 and the boat's 2 internal fuel tank. This type of valve is typically standard on most boats and allows selection between internal and external fuel tanks. Additionally, the fuel could be transported to a particular place where it will be used in other ways and not consumed by boat 2.

Figure 8:
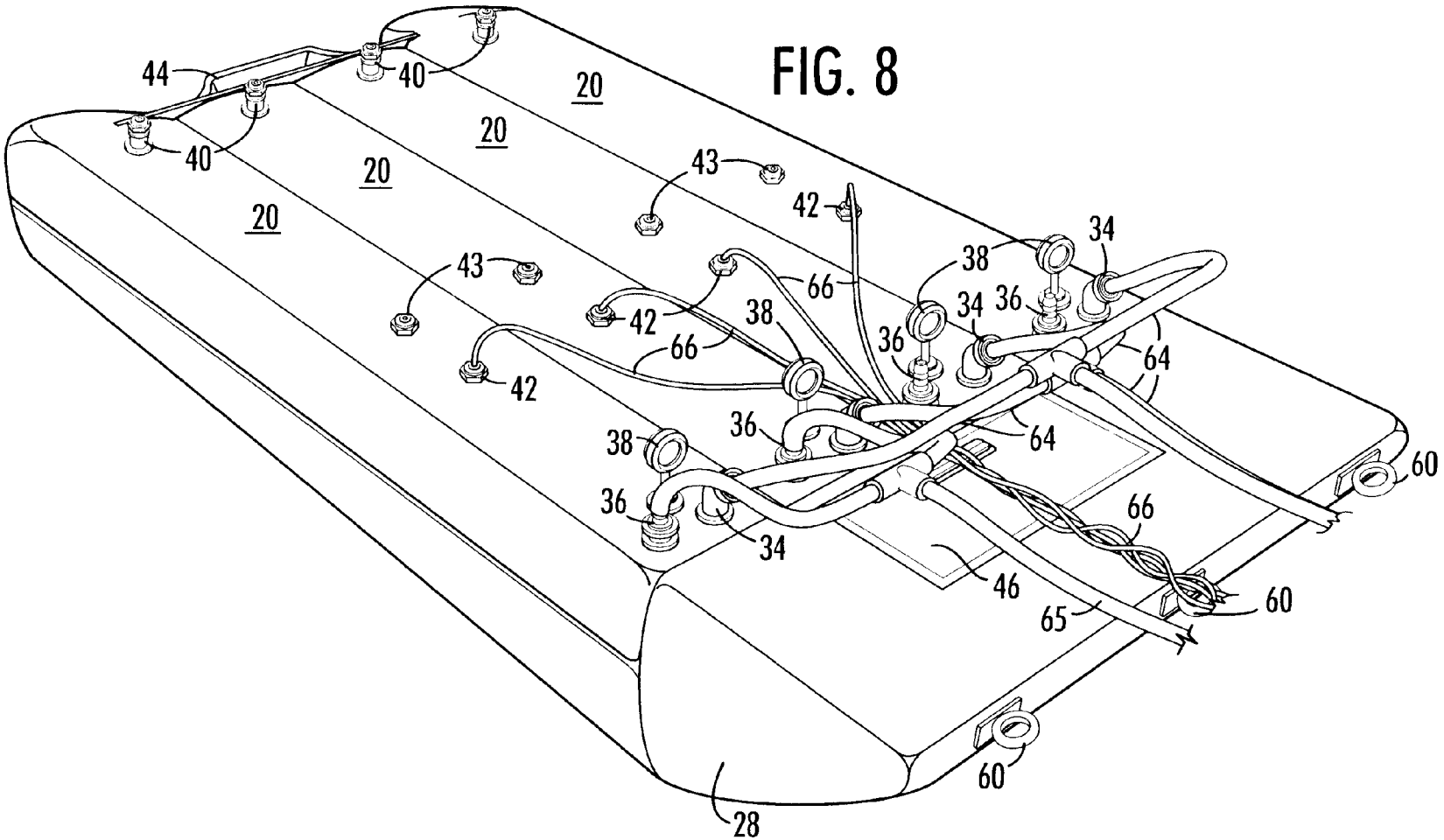
FIG. 8 is a top view of the tank configured for a diesel engine, according to an alternative preferred embodiment of the present invention.

A fuel line 64 is in fluid communication with fuel inlet 34. Fuel inlet 34 provides fluid communication between fuel line 64 and fuel intake line 30. Fuel intake lines 30 and fuel lines 64 allow fluid communication between fuel chambers 22 and the engine (not shown) on boat 2. Fuel intake lines 30 preferably are positioned near the bottom 18 and extend to the stern 14 of fuel chamber 22 to allow consumption of all fuel in fuel chamber 22. If tank 10 is configured with a diesel engine, return fuel lines 65 are used to return excess fuel to the fuel chambers 22 as illustrated in FIG. 8. Return fuel lines 65 are in fluid communication with fuel fill connector 36 so that excess fuel is drained through fuel fill connector 36 into fuel chambers 22. Fuel lines 64, return fuel lines 65, and fuel intake lines 30 may be standard fuel lines that are made from a synthetic rubber tubing, such as neoprene.

For self leveling, preferably the outermost fuel chambers 22 have an outer channel 25 extending therebetween to allow fluid communication between bladders 20. Outer channel 25 should not allow fluid communication between outer fuel chambers 22 and inner fuel chambers 22. Likewise, inner-most fuel chambers 20 preferably have an inner channel 24 extending therebetween to allow fluid communication between bladders. Neither outer channel 25 nor inner channel 24 are otherwise necessary for the operation of tank 10. For bladders 20 having fluid communication using channels 24, only a single fuel line 64 positioned on either bladder 20 is needed. However, each bladder 20 should still have a fuel intake line 30. A fuel fill connector 36 is preferably positioned in fluid communication with each fuel chamber 22. For fuel chambers 22 having a channel therebetween, only a single fuel fill connector 36 on either fuel chamber 22 is needed.

Fuel chambers 22 are preferably maintained at a particular pressure. Any of the various devices for maintaining a particular pressure within a fuel tank known in the art could be used. Each fuel chamber 22 preferably has an operational connection to a pressure sensor (not shown) that activates an air pump positioned on boat 2. As fuel is drawn from fuel chamber 22, an air pump is activated and supplies air through air lines 66 to fill fuel chamber 22 with air in order to maintain a particular pressure. An air line 66 is preferably positioned in fluid communication with each fuel chamber 22. For fuel chambers 22 having a channel therebetween, only a single air line 66 on either fuel chamber 22 is needed.

Preferably, fuel is first drawn from the outer fuel chambers 22. Upon exhausting the fuel supply of the outer fuel chambers 22, fuel is drawn from another fuel chamber 22 having a supply of fuel. Any of the various devices known in the art for automatically switching between the fuel chambers 22, such as a multi-way solenoid valve, could be used. A fuel gauge 38 in operable connection with each fuel chamber 22 could display the remaining supply of fuel in each fuel chamber 22. Fuel gauge 38 could be used in conjunction with a switching device (not shown) for selecting the particular fuel chamber that fuel is to be drawn therefrom.

Air chambers 26 are preferably maintained at a particular pressure. Air chambers 26 have vent holes 40 that release air if a particular pressure within an air chamber 26 is exceeded. Any mechanism for release of excess pressure through vent hole 40 could be used. Air chambers 26 may be filled with air using air valves 43 positioned on the top of each bladder 20. Air valves 43 are capable of interfacing with a pump (not shown) to increase pressure within air chamber 26. Additionally, air valves 42 in fluid communication with fuel chambers 22 can also be used with a pump (not shown) to increase air pressure within fuel chamber.

Tank 10 is collapsible if either fuel or air are removed and it may be then stored on the deck of boat 2. In order to be collapsible, tank 10 is formed from a flexible, non-elastic material. Any flexible, non-elastic material known in the art that does not easily deteriorate upon contact with the fuel or water could be used to form tank 10, such as neoprene.

In operation as an external fuel tank, the tank 10 is pulled behind a vessel using towing lines 62. The fuel held by the tank 10 is in fluid communication with the engine on the vessel 2. Engine on the vessel preferably consumes fuel from the tank 10; instead, the engine may use its internal fuel tank and transfer fuel from tank 10 to internal fuel tank during a stop; alternatively, fuel may be transported to a separate destination where it will be used.

In operation under emergency situations, tank 10 may be used as a lifeboat as illustrated in FIG. 7. In this case, fuel is drained from the barge and then it is filled with air. Drain plugs 54 positioned on bottom of tank 10, allow draining of fuel from fuel chambers 22. Preferably each fuel chamber 22 has a drain plug 54; however, for fuel chambers 22 having a channel therebetween, only a single drain plug 54 on either fuel chamber 22 is needed. A transom 44 on tank 10 allows an engine (not shown) to be placed on the barge in emergency situations or for transportation under normal situations. Preferably, the air from inner air chambers is expelled to create a depression for sitting. A storage compartment 46 provides a hollow cavity for storage of emergency supplies.

It will be apparent to those skilled in the art that many changes and substitutions can be made to the preferred embodiment herein described without departing from the spirit and scope of the present invention.

What is claimed is:

1. An auxiliary fuel tank, said fuel tank comprising:

a bladder capable of holding a quantity of fuel, said bladder capable of floating on water;

means for maintaining a particular pressure within said bladder; and towing means carried by said bladder for detachably securing said bladder to a vessel so that said bladder may be towed behind said vessel.

2. The fuel tank as recited in claim 1, further comprising means for transferring said fuel from said bladder to a fuel tank on said vessel.

3. The fuel tank as recited in claim 1, further comprising means for transferring said fuel from said bladder to the engine of said vessel.

4. The fuel tank as recited in claim 1, wherein said bladder is elongated with a major dimension extending from said bow to said stern.

5. The tank as recited in claim 1, wherein said bladder has a fuel chamber and an air chamber.

6. The tank as recited in claim 1, wherein said bladder has a fuel chamber and an air chamber.

7. An auxiliary fuel tank for a vessel, said fuel tank comprising:

a bladder capable of holding a quantity of fuel, said bladder capable of floating on water;

means for maintaining a particular pressure within said bladder;

towing means carried by said bladder detachably securing said bladder to a vessel so that said bladder may be towed behind said vessel; and means for transferring said fuel from said bladder to said vessel.

8. The fuel tank as recited in claim 7, wherein said transferring means transfers fuel from said bladder to said vessel so that said fuel is immediately consumed by said vessel.

9. The fuel tank as recited in claim 7, wherein said bladder is elongated with a major dimension extending from said bow to said stern.

10. The tank as recited in claim 7, wherein said bladder has a fuel chamber and an air chamber.

11. The tank as recited in claim 7, wherein said bladder has a fuel chamber and an air chamber.

12. An auxiliary fuel tank for a vessel, said fuel tank comprising:

a bladder capable of holding a quantity of fuel, said bladder capable of floating on water, wherein said bladder has an upper chamber and a lower chamber, said upper chamber being capable of holding air and said lower chamber being capable of holding fuel;

towing means carried by said bladder detachably securing said bladder to a vessel so that said bladder may be towed behind said vessel; and means for transferring said fuel from said bladder to said vessel.

13. The fuel tank as recited in claim 12, wherein said transferring means transfers fuel from said bladder to said vessel so that said fuel is immediately consumed by said vessel.

14. The fuel tank as recited in claim 12, further comprising a transom for attaching an engine to said fuel tank.

15. The tank as recited in claim 12, further comprising means for maintaining a particular pressure within said bladder.

16. The tank as recited in claim 12, wherein said bladder has a fuel chamber and an air chamber, said fuel chamber having means for maintaining a particular pressure.

17. The tank as recited in claim 12, wherein said bladder has a fuel chamber and an air chamber, said air chamber having means for maintaining a particular pressure.

* * * * *